US009194015B2

(12) United States Patent
Ikeda et al.

(10) Patent No.: US 9,194,015 B2
(45) **Date of Patent: *Nov. 24, 2015**

(54) DUAL PHASE STEEL SHEET WITH GOOD BAKE-HARDENING PROPERTIES

(75) Inventors: Shushi Ikeda, Kobe (JP); Koichi Makii, Kobe (JP); Hiroshi Akamizu, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/477,299

(22) Filed: Jun. 3, 2009

(65) Prior Publication Data

US 2009/0242085 A1 Oct. 1, 2009

Related U.S. Application Data

(63) Continuation of application No. 10/639,588, filed on Aug. 13, 2003, now abandoned.

(30) Foreign Application Priority Data

Aug. 20, 2002 (JP) ..... 2002-239816

(51) Int. Cl.
*C21D 8/02* (2006.01)
*C22C 38/00* (2006.01)
(Continued)

(52) U.S. Cl.
CPC ..... *C21D 1/20* (2013.01); *C21D 8/0426* (2013.01); *C21D 8/0436* (2013.01);
(Continued)

(58) Field of Classification Search
CPC .. C21D 2211/002; C21D 1/20; C21D 8/0426; C21D 8/0436; C21D 8/0473; C21D 8/02; C21D 2211/001; C21D 2211/005; C22C 38/001; C22C 38/12; C22C 38/02; C22C 38/04; C22C 38/06; C22C 38/002
See application file for complete search history.

(56) References Cited

U.S. PATENT DOCUMENTS 4,854,976 A * 8/1989 Era et al. ..... 148/547
5,352,304 A * 10/1994 DeArdo et al. ..... 148/336
(Continued)

FOREIGN PATENT DOCUMENTS

EP 586704 3/1994
EP 0 952 235 10/1999
(Continued)

OTHER PUBLICATIONS

Bainite. Dictionary.com. Dictionary.com Unabridged (v 1.1). Random House, Inc. http://dictionary.reference.com/browse/bainite (accessed: Aug. 7, 2010).*
(Continued)

*Primary Examiner* — Jessee Roe
(74) *Attorney, Agent, or Firm* — Oblon, McClelland, Maier & Neustadt, L.L.P.

(57) ABSTRACT

A dual phase steel sheet with good bake-hardening properties is provided. The steel sheet is characterized in containing (in terms of percent by mass) C: no less than 0.06% and less than 0.25%; Si+Al: 0.5 to 3%; Mn: 0.5 to 3%; P: no more than 0.15%; and S: no more than 0.02%; and also meeting the following condition (in terms of space factor) that retained austenite is at least 3%, bainite is at least 30%, and ferrite is no more than 50%, and further characterized in differing in stress larger than 50 MPa before and after application of 2% pre-strain and ensuing heat treatment for paint baking at 170° C. for 20 minutes. The steel sheet has well-balanced strength and workability, exhibits good bake-hardening properties at the time of paint baking, and offers good resistance to natural aging.

6 Claims, 5 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C21D 1/20*** | (2006.01) |
| ***C21D 8/04*** | (2006.01) |
| ***C22C 38/12*** | (2006.01) |

(52) U.S. Cl.

CPC ..... *C21D 8/0473* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C21D 8/02* (2013.01); *C21D 2211/001* (2013.01); *C21D 2211/002* (2013.01); *C21D 2211/005* (2013.01)

(56) References Cited

U.S. PATENT DOCUMENTS

| | | | | |
|---|---|---|---|---|
| 5,746,842 | A | 5/1998 | Eguchi et al. | |
| 6,280,538 | B1 | 8/2001 | Soshiroda et al. | |
| 6,306,527 | B1 | 10/2001 | Ikeda et al. | |
| 6,316,127 | B1 | 11/2001 | Ikeda et al. | |
| 6,319,338 | B1 * | 11/2001 | Kawano et al. | 148/328 |
| 7,455,736 | B2 | 11/2008 | Kashima et al. | |
| 7,553,380 | B2 | 6/2009 | Ikeda et al. | |
| 7,591,977 | B2 * | 9/2009 | Ikeda et al. | 420/120 |
| 8,597,439 | B2 * | 12/2013 | Ikeda et al. | 148/320 |
| 2004/0035500 | A1 | 2/2004 | Ikeda et al. | |
| 2005/0150580 | A1 | 7/2005 | Akamizu et al. | |
| 2005/0161134 | A1 | 7/2005 | Ikeda et al. | |
| 2005/0247378 | A1 | 11/2005 | Ikeda et al. | |
| 2006/0137768 | A1 | 6/2006 | Yuse et al. | |
| 2006/0137769 | A1 | 6/2006 | Yuse et al. | |
| 2008/0251160 | A1 | 10/2008 | Akamizu et al. | |
| 2008/0251161 | A1 | 10/2008 | Kashima et al. | |

FOREIGN PATENT DOCUMENTS

| | | |
|---|---|---|
| EP | 0 997 548 | 5/2000 |
| EP | 1 201 780 | 5/2002 |
| EP | 1 207 213 | 5/2002 |
| JP | 61-217529 | 9/1986 |
| JP | 403180445 | 8/1991 |
| JP | 05-117761 | 5/1993 |
| JP | 10-237547 | 9/1998 |
| JP | 11-021653 | 1/1999 |
| JP | 11-193439 | 7/1999 |
| JP | 11-256273 | 9/1999 |
| JP | 11-279694 | 10/1999 |
| JP | 411323490 | 11/1999 |
| JP | 2000-80440 | 3/2000 |
| JP | 2000-282175 | 10/2000 |
| JP | 2000-297350 | 10/2000 |
| JP | 2001-11565 | 1/2001 |
| JP | 2001-262271 | 9/2001 |
| JP | 2001-303185 A | 10/2001 |
| JP | 2002-105593 | 4/2002 |
| JP | 2002115025 | 4/2002 |

OTHER PUBLICATIONS

Bainite. (n. d.). Dictionary.com Unabridged. Retrieved Feb. 19, 2014, from Dictionary.com website: http://dictionary.reference.com/browse/bainite.*

AMS International, Materials Part, Ohio, Properties and Selection: Irons, Steels, and High Performance Alloys, "Classification and Designation of Carbon and Low Alloy Steels", Mar. 1990, pp. 144-147.

AMS International, Materials Park, Ohio, Properties and Selection: Irons, Steels and High Performance Alloys, "Sheet Formability of Steels", Mar. 1990, pp. 573-580.

U.S. Appl. No. 12/159,400, filed Apr. 24, 2009, Kinugasa, et al.

U.S. Appl. No. 12/303,634, filed Dec. 5, 2008, Nakaya, et al.

U.S. Appl. No. 12/303,566, filed Dec. 5, 2008, Nakaya, et al.

European Search Report issued Aug. 11, 2011, in Patent Application No. 03255043.6.

Osamu Matsumura, et al., "Enhancement of Elongation by Retained Austenite in Intercritical Annealed 0.4C-1.5Si-0.8Mn Steel", Transations ISIJ, vol. 27, 1987, pp. 570-579.

M. De Meyer, et al., "The bake hardening and ageing behaviour of cold rolled TRIP steels", 43rd MWSP Conf. Proc., ISS, vol. XXXIX, 2001, pp. 349-358.

European Office Action issued Sep. 20, 2013, in European Patent Application No. 1 391 526 (03 255 043.6) with English translation.

* cited by examiner

×4,000 5 μm

×4,000 5 μm

DUAL PHASE STEEL SHEET WITH GOOD BAKE-HARDENING PROPERTIES

CROSS-REFERENCE TO RELATED APPLICATIONS

This application is a continuation of U.S. patent application Ser. No. 10/639,588 filed on Aug. 13, 2003, now abandoned.

BACKGROUND OF THE INVENTION

1. Field of the Invention

The present invention relates to a dual phase steel sheet with good bake-hardening properties and, more particularly, to a dual phase steel sheet having well-balanced strength and forming properties. This steel sheet has not only good bake-hardening properties but also good resistance to natural aging. (The term "bake-hardening properties" implies that the steel sheet improves in strength upon paint baking. The term "resistance to natural aging" implies that the steel sheet retains its characteristic properties (such as forming properties) without deterioration after aging at room temperature). The dual phase steel sheet according to the present invention will be widely used in automotive, electric, and machine industries and other industrial fields. The following description is mainly concerned with its use in automotive bodies as a typical example.

2. Description of the Related Art

There has been an increasing demand for steel sheets for automotive use which are thinner (for improved fuel consumption) and stronger (for improved collision safety) than before. Such steel sheets are required to exhibit good forming properties at the time of forming, such as press working. Unfortunately, improved strength often has an adverse effect on forming properties. Steel sheets for automotive use, which undergo complicated forming, are required to be comparatively soft (for easy forming) at the time of press working and to become highly strong at the time of heat treatment to bake the coating thereon which follows press working.

The above-mentioned bake-hardening is due to strain aging that occurs at a high temperature (about 150-200° C.) for paint baking. Strain aging results from interstitial elements (C and N) fixing dislocations. Therefore, paint baking offers the advantage of imparting high strength to the final product.

Incidentally, strain aging occurs also at normal temperature, and in this case, dissolved carbon and nitrogen in the steel migrate to fix dislocations even before paint baking. Any steel sheet with strain aging at normal temperature is poor in ductility due to yield elongation, and poor ductility leads to flaws (such as wrinkles) at the time of press working.

Consequently, automotive steel sheets are required to readily undergo strain aging at high temperatures for paint baking, thereby increasing in strength, and hardly undergo strain aging at normal temperature. In other words, they are required to be good in bake-hardening and also in resistance to natural aging.

Under these circumstances, there have been proposed steel sheets with improved bake-hardening, such as BH steel of quasi-IF (Interstitial Free) type. It contains about 30 ppm of dissolved carbon in the ferrite structure, so that dissolved carbon fix dislocations, thereby improving the bake-hardening properties. It is used mainly for the outer panel of automobiles.

Unfortunately, the BH steel of quasi-IF type mentioned above has a strength of about 440 MPa at most even after bake-hardening on account of its low content of dissolved carbon.

There is a kind of DP steel (Dual Phase Steel) which contains dislocations introduced into the parent phase ferrite by martensitic transformation. It has a low value of yield point as such but has a high value of yield point due to hardening after paint baking which fixes the above-mentioned dislocations and other dislocations introduced by working.

Moreover, there is a kind of so-called TRIP steel which is designed to improve the bake-hardening properties. TRIP steel is a steel which contains retained austenite of several to tens of percent in the metal structure, so that it exhibits high toughness after plastic forming. For example, Japanese Patent Laid-open No. 11565/2001 discloses a technology for increasing the amount of bake-hardening. This technology aims at developing a steel sheet that absorbs a large amount of collision energy to meet both requirements for safety of passenger cars and weight reduction of car body.

Generally, a conceivable mechanism which makes TRIP steel improve in bake-hardening is the bonding of carbon which originally exists in the ferrite to dislocations induced by working, as in the case of above-mentioned dual phase steel. This conception, however, does not explain why the steel increases in strength by 50 MPa or more by bake-hardening. Another conceivable mechanism has been proposed as follows. Retained austenite is transformed into martensite by plastic forming before bake-hardening. Carbon in the martensite releases itself at the time of paint baking. This carbon bonds to the dislocations in ferrite which have been introduced during working. In this way, hardening takes place.

Improvement in TRIP steel which inherently has well-balanced strength and workability has been made to provide a new steel sheet capable of high bake-hardening at the time of paint baking, as mentioned above. However, a steel sheet with high bake-hardening poses problems with increased yield point, decreased elongation, and aging namely deterioration with time in characteristic properties. These phenomena could possibly occur as follows. First, dislocations form from skin pass rolling or martensitic transformation during production, and then these dislocations catch carbon which has diffused and migrated from retained austenite after its decomposition that takes place for one reason or another, since TRIP steel contains retained austenite with a large amount of dissolved carbon. As the result, deterioration in characteristic properties such as increased yield point and decrease of elongation occurs. Such a steel sheet exhibits good workability immediately after production but deteriorates with time due to aging when it is worked by the user. Japanese Patent Laid-open No. 297350/2000 proposes an idea that a steel sheet is improved in bake-hardening properties and resistance to natural aging when it has the dual phase structure in which the principal phase is ferrite and the second phase is at least one of pearlite, bainite, martensite, and retained austenite, with dissolved nitrogen controlled in amount and positions where it exists. However, there seems to be room for further improvement in elongation.

SUMMARY OF THE INVENTION

The present invention was completed in view of the foregoing. It is an object of the present invention to provide a dual phase steel sheet having good bake-hardening properties as well as good resistance to natural aging.

The gist of the present invention resides in a dual phase steel sheet with good bake-hardening properties which is characterized in containing (in terms of percent by mass):

C: no less than 0.06% and less than 0.25%,

Si+Al: 0.5 to 3%,

Mn: 0.5 to 3%,

P: no more than 0.15% (excluding 0%), and

S: no more than 0.02% (excluding 0%), and also meeting the following condition (in terms of space factor):

retained austenite: at least 3%, bainite: at least 30%, and ferrite: no more than 50% (including 0%), and further characterized in differing in stress larger than 50 MPa (preferably larger than 100 MPa) before and after ensuing heat treatment for paint baking at 170° C. for 20 minutes, after application of 2% pre-strain.

For better bake-hardening properties, the steel sheet should preferably have a space factor of bainite more than 60%.

The preferred embodiments of the present invention include the following.

(1) The dual phase steel sheet as defined above which is characterized in further containing at least one of the following constituents (in terms of percent by mass):

Mo: no less than 0.05% and no more than 1%,

Ni: no less than 0.05% and no more than 0.5%,

Cu: no less than 0.05% and no more than 0.5%, and

Cr: no less than 0.05% and no more than 1%.

(2) The dual phase steel sheet as defined above which is characterized in further containing at least one of the following constituents (in terms of percent by mass):

Ti: no less than 0.01% and no more than 0.1%,

Nb: no less than 0.01% and no more than 0.1%, and

V: no less than 0.01% and no more than 0.1%.

(3) The dual phase steel sheet a3 defined above which is characterized in further containing (in terms of percent by mass):

Ca: no less than 3 ppm and no less than % and no more than 30 ppm and/or,

REM: no less than 3 ppm and no more than 30 ppm.

The present invention mentioned above provides a steel sheet which has well-balanced strength and workability, exhibits good bake-hardening properties at the time of paint baking, and offers good resistance to natural aging, by virtue of its unique structure in which bainite is the principle constituent and retained austenite and ferrite are present in a specified amount. This steel sheet exhibits outstanding workability at the time of forming and also exhibits high strength after paint baking.

DESCRIPTION OF THE PREFERRED EMBODIMENTS

Figure 1:
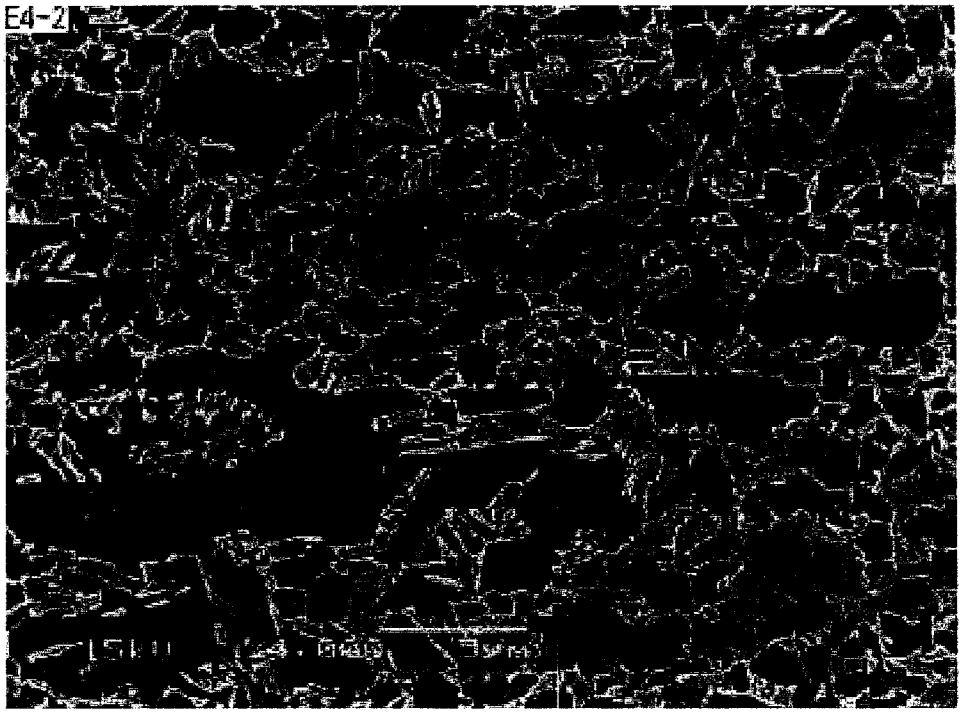
FIG. 1 is an SEM microphotograph showing one example of the structure of the steel sheet according to the present invention.

Under the circumstances mentioned above, the present inventors carried out extensive studies on the development of a new dual phase steel sheet with good bake-hardening properties which keeps good workability without aging and yet increases in strength upon paint baking.

The results of the studies revealed that the steel sheet exhibits better bake-hardening properties than before if it is composed mainly of bainite and it has a high initial dislocation density at the time of production. The present invention is based on a finding that the steel sheet is effectively relieved from age hardening at normal temperature if it has the structure of so-called TRIP steel containing retained austenite, with dissolved carbon bonding to dislocations introduced at the time of production.

As mentioned above, the steel sheet of the present invention has the structure which is composed of at least 3% of retained austenite, at least 30% of bainite, and no more than 50% (including 0%) of ferrite, in terms of space factor. These space factors were established for the reasons given below.

Bainite (at Least 30%)

The steel sheet of the present invention is characterized most by being composed mainly of bainite. It differs in structure from the conventional TRIP steel as follows. Being composed of ferrite and pearlite as the principal phase, the conventional TRIP steel has the disadvantage of not keeping sufficient dislocations at the time of steel sheet production, and the resulting steel sheet is poor in bake-hardening properties. By contrast, the steel sheet of the present invention is composed mainly of bainite and it has a high initial dislocation density. Therefore, it exhibits much better bake-hardening properties than any other conventional steel sheets at the time of paint baking, which leads to a greatly improved strength due to strain aging.

For the steel sheet to produce such an effect, it should have the structure in which the amount of bainite is at least 30%, preferably more than 60%, more preferably more than 70%, and most preferably more than 80%. Also, for the steel sheet to exhibit good bake-hardening properties at the time of paint baking and to have good resistance to natural aging, it should substantially have the dual-phase structure composed of retained austenite and bainite.

Retained Austenite (at Least 3%)

Retained austenite contributes to improvement in total elongation. For the steel sheet to produce such an effect, it should contain retained austenite as much as at least 3%, preferably more than 5%, more preferably more than 7%, and most preferably more than 10%, in terms of space factor. The upper limit should be 30%, preferably 25%; retained austenite with an excess space factor deteriorates stretch flange formability.

As mentioned above, the steel sheet of the present invention keeps as much retained austenite as necessary to hold therein the dissolved carbon and nitrogen which fix dislocations. In this way the retained austenite prevents dislocations from being fixed by dissolved carbon and nitrogen at normal temperature. Therefore, the steel sheet is relieved from age hardening at normal temperature even in the case where a large number of dislocations are introduced at the time of production.

Retained austenite should preferably contain more than 0.8% of carbon for better elongation.

Ferrite (No More than 50%, Including 0%)

The point of the present invention lies in the fact that the steel sheet is composed mainly of bainite so that it has good bake-hardening properties. The present inventors found that the object of the present invention is achieved so long as the steel sheet contains as much bainite and retained austenite as specified above even though its ferrite content is less than 50%.

The foregoing is apparent from FIG. 1 which is an SEM microphotograph (×4000) showing the structure of the steel sheet of the present invention. In this photograph, the black background represents ferrite and the gray parts represent bainite or retained austenite. It was found that the steel sheet has good bake-hardening properties even though its structure is composed mainly of bainite, with the remainder (45%) being ferrite.

The steel sheet becomes better in bake-hardening properties as the amount of ferrite decreases and the amount of bainite relatively increases. Therefore, the amount of ferrite should be less than 30%, preferably less than 25%, and more preferably 0%.

The steel sheet may contain ferrite in an amount more than 10% and less than the upper limit specified above so that it has good elongation characteristics as well as good workability.

Others: Pearlite and Martensite (Minimal, Including 0% in Terms of Space Factor)

The steel sheet of the present invention usually have the mixed structure mentioned above (which consists of retained austenite, ferrite, and bainite, or consists of retained austenite and bainite). However, the mixed structure may additionally contain pearlite and martensite in an amount not harmful to the desired characteristic properties. These constituents inevitably enter the structure in the manufacturing process; their content should preferably be as little as possible.

The steel sheet of the present invention is composed of the basic constituents listed below. The amount of constituents is expressed in terms of mass %.

C: No Less than 0.06% and Less than 0.25%

Carbon is an element essential for the steel sheet to exhibit high strength and to contain retained austenite. In other words, carbon sufficiently existing in the austenite phase permits the austenite phase to remain as much as desired at normal temperature. The content of carbon necessary to produce this effect is no less than 0.06%, preferably no less than 0.10%. However, for the steel sheet to have good weldability, the content of carbon should be less than 0.25%, preferably less than 0.20%.

Si+Al: 0.5-3%

Silicon and aluminum are elements to prevent retained austenite from decomposing to give carbides. Silicon plays an important role in solid solution strengthening. The total amount of silicon and aluminum necessary for this effect is no less than 0.5%, preferably no less than 0.7%, and more preferably no less than 1%. However, it should be less than 3%, preferably less than 2.5%, and more preferably less than 2%, because excess silicon and aluminum more than 3% are wasted and lead to high temperature brittleness.

Mn: 0.5-3%

Manganese stabilizes austenite to give as much retained austenite as desired. The amount of manganese to produce this effect is no less than 0.5%, preferably no less than 0.7%, and more preferably no less than 1%. However, its upper limit should be 3%, preferably 2.5%, and more preferably 2%, because excess manganese produces an adverse effect such as ingot cracking.

P: No More than 0.15% (Excluding 0%)

Phosphorus secures as much retained austenite as desired. The amount of phosphorus to produce this effect is no less than 0.03%, preferably no less than 0.05%. However, its upper limit is 0.15%, preferably 0.1%, because excess phosphorus adversely affects secondary workability.

S: No More than 0.02% (Including 0%)

Sulfur forms sulfide inclusions such as MnS, which bring about a starting point of cracking, thereby deteriorating workability. The amount of sulfur should be no more than 0.02%, preferably no more than 0.015%.

N: No More than 60 ppm (Excluding 0%)

Excess nitrogen causes a large amount of nitride to precipitate, thereby deteriorating ductility. Therefore, the amount of nitrogen should be no more than 60 ppm, preferably no more than 50 ppm, and more preferably no more than 40 ppm. The less the amount of nitrogen in the steel sheet, the more desirable. However, the lower limit of the amount of nitrogen is about 10 ppm, depending on how much of nitrogen the process employed Can reduce.

The steel sheet of the present invention is made up of the above-mentioned principal constituents, with the remainder being substantially iron and inevitable impurities. It may additionally contain the following components in an amount not harmful to the effect of the present invention.

At least any one of:

Mo: no less than 0.05% and no more than 1%

Ni: no less than 0.05% and no more than 0.5%

Cu: no less than 0.05% and no more than 0.5%

Cr: no less than 0.05% and no more than 1%

These elements strengthen the steel sheet and stabilize retained austenite and secure as much retained austenite as necessary. For these elements to produce their desired effects, it is recommended that the steel sheet contain each of them in an amount no less than 0.05%, preferably no less than 0.1%, as follows.

Mo: no less than 0.05% (preferably no less than 0.1%);

Ni: no less than 0.05% (preferably no less than 0.1%);

Cu: no less than 0.05% (preferably no less than 0.1%); and

Cr: no less than 0.05% (preferably no less than 0.1%).

Mo and Cr in excess of 1% and Ni and Cu in excess of 0.5% will be wasted without extra effect. Therefore, their desirable amounts are as follows.

Mo: no more than 0.8%; Ni: no more than 0.4%;

Cu: no more than 0.4%; Cr: no more than 0.8%.

At least any one of:

Ti: no less than 0.01% and no more than 0.1%

Nb: no less than 0.01% and no more than 0.1%

V: no less than 0.01% and no more than 0.1%

These elements contribute to precipitation strengthening and fine structure, that is, they make the steel sheet strong. For these elements to produce their desired effects, it is recommended that the steel sheet contain each of them in an amount no less than 0.01%, preferably no less than 0.02%, as follows.

Ti: no less than 0.01% (preferably no less than 0.02%);

Nb: no less than 0.01% (preferably no less than 0.02%);

V: no less than 0.01% (preferably no less than 0.02%).

When used in excess of 0.1%, they will be wasted without extra effect. Therefore, their desirable amounts are as follows.

Ti: no more than 0.08%; Nb: no more than 0.08%; and

V: no more than 0.08%.

Ca: no less than 3 ppm and no more than 30 ppm, and/or

REM: no less than 3 ppm and no more than 30 ppm

Ca and REM (rare earth elements) control the form of sulfides in the steel sheet, thereby improving workability. The rare earth elements include Sc, Y, and lanthanoid. For these elements to produce their desired effects, it is recommended that the steel sheet contain each of them in an amount no less than 3 ppm, preferably no less than 5 ppm. When used in excess of 30 ppm, they are wasted without extra effect. Therefore, their desired amount is no more than 25 ppm.

The steel sheet of the present invention may be produced by any method without specific restrictions. However, it will have the structure characteristic of the present invention if hot rolling or cold rolling is followed by continuous annealing or plating which is carried out under the following conditions.

(1) Keep the steel sheet at a temperature higher than $A_3$ point for 10-200 seconds.

(2) Cool the steel sheet to the bainite transformation temperature (about 500-350° C.) at an average cooling rate larger than 3° C./s, thereby avoiding pearlite transformation.

(3) Keep the steel sheet at said temperature for more than one second.

The isothermal treatment at a temperature higher than $A_3$ point completely dissolves carbides to form retained austenite as desired. It also effectively yields bainite with a high dislocation density in its ensuing cooling step. Heating at said temperature should last for 10-200 seconds. Excessively brief heating does not produce the desired effect. Excessively elongated heating results in coarse crystal grains. An adequate length is 20-150 seconds.

Subsequently, the steel sheet should be cooled to the bainite transformation temperature (about 500-350° C.) at an average cooling rate larger than 3° C./s, preferably larger than 5° C./s, for avoidance of pearlite transformation.

The controlled average cooling rate mentioned above helps introduce a large number of dislocations, thereby imparting the desired bake-hardening properties (defined by as a difference in stress larger than 50 MPa before and after ensuing heat treatment for paint baking at 170° C. for 20 minutes, after application of 2% pre-strain). Better bake-hardening properties with a difference in stress larger than 100 MPa may be attained if cooling is accomplished by using water-cooled rolls, so that the average cooling rate is greater than 5° C./s. The cooling rate should be as great as possible to improve the bake-hardening properties; however, an adequate cooling rate should be established from the practical point of view.

The control of the cooling rate specified above should be maintained until the bainite transformation temperature is reached. If the control of the cooling at the above specified rate (rapid cooling) is suspended while the steel sheet is still hotter than the bainite transformation temperature and is followed by slow cooling, the resulting steel sheet is poor in bake-hardening properties due to insufficient dislocations and is also poor in elongation due to insufficient retained austenite. On the other hand, if cooling at the above specified rate is continued until a lower temperature than the bainite transformation temperature, the resulting steel sheet is liable to age hardening at normal temperature and is poor in elongation due to insufficient retained austenite.

After cooling, the steel sheet should be kept at the specified temperature for more than one second, so that carbon efficiently concentrates in retained austenite in a short time, giving rise to a large amount of stable retained austenite. The resulting retained austenite greatly contributes to the TRIP effect. However, an excessively long holding time should be avoided because the resulting steel sheet is poor in bake-hardening properties due to recovery, namely decrease of dislocations formed by cooling.

To summarize, since the initial dislocations exist in bainite phase, increase of the ratio of bainite phase itself provides increase of the initial dislocation density. In addition, the cooling rate to the bainite transformation temperature (the higher, the better) and the temperature and time to keep at the bainite transformation temperature are the factors to effect the initial dislocation density.

The above-mentioned heat treatment may be accomplished, for example, by heating/cooling using a salt bath or CAL simulator, or by water cooling.

The cooling to normal temperature after the keeping at the specified temperature may be accomplished by air cooling or water cooling without any specific restrictions. Moreover, the steel sheet may undergo plating or alloying to modify the structure as desired to such an extent not harmful to the effect of the present invention.

The steel sheet of the present invention may be produced by either of the following steps which include the above-mentioned steps.

(a) "Hot rolling step"→"Continuous annealing step or plating step"

(b) "Hot rolling step"→"Cold rolling step"→"Continuous annealing step or plating step"

The hot rolling and cold rolling may be carried out under ordinary conditions without specific restrictions. However, their ensuing steps, namely continuous annealing and plating, under controlled conditions are more influential in formation of the desired structure in the steel sheet of the present invention.

To be more specific, the hot rolling step should be completed at a temperature higher than the $Ar_3$ point. Then the rolled steel sheet should be cooled at an average cooling rate of about 30° C./s and finally wound up at about 500-600° C. In addition, the cold rolling step may be carried out at a draft of about 30-70%. These conditions are not mandatory, as a matter of course.

The invention will be described in more detail with reference to the following examples, which are not intended to restrict the scope thereof. The examples may be modified without altering the scope of the invention.

EXAMPLES

An experimental slab was prepared from a vacuum-melted steel having the composition shown in Table 1. The slab was made into a steel sheet, 2.4-3.2 mm thick, by hot rolling under the following conditions.

Starting temperature: 1100° C.

Finishing temperature: 850° C.

Winding temperature: 600° C.

After acid pickling, the hot-rolled steel sheet was cold-rolled (with a draft of 50-75%) for reduction of thickness to 1.0-1.6 mm.

Figure 2:
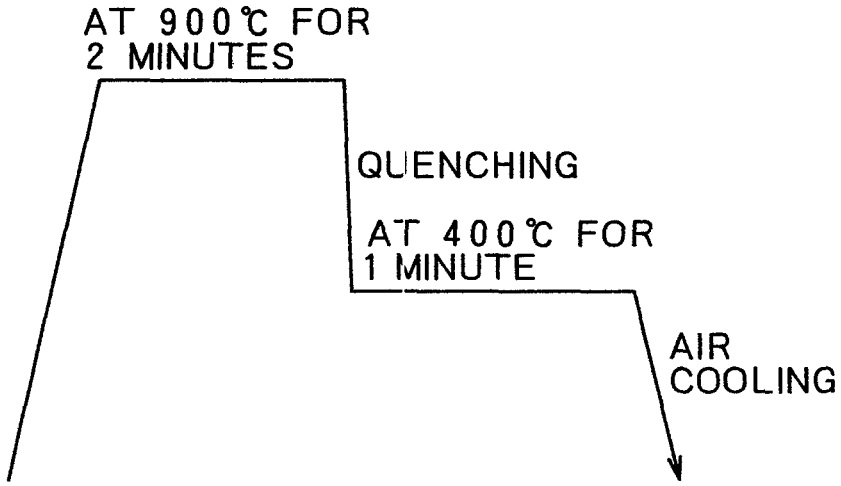
FIG. 2 is a diagram illustrating the heat treatment carried out in one Example.

The cold-rolled steel sheet subsequently underwent heat treatment as illustrated in FIG. 2 by a continuous annealing line (CAL). To be more specific, in the Samples Nos. 1 to 14 mentioned later, the steel sheet was kept at 900° C. for 2 minutes in a salt bath, quenched in another salt bath at 400° C., kept at 400° C. for 1 minute in the same salt bath, and finally air-cooled to room temperature. After cooling, the steel sheet underwent skin pass rolling, with the reduction of area being 0.5-2%. It was finally wound up.

The thus obtained steel sheet was examined for structure by observation under an optical microscope and a scanning electron microscope (SEM) after Lepera etching. The areal ratio of ferrite and bainite was obtained from the microphotographs. The space factor of retained austenite was obtained by X-ray measurement.

The specimens were further tested for tensile strength (TS), total elongation (El), bake-hardening properties (BH), and resistance to natural aging in the following manner.

In tensile testing, test specimens conforming to JIS No. 5 were used for measurement of tensile strength (TS) and elongation (El). Bake-hardening properties were determined from $\sigma_2$-$\sigma_1$, where $\sigma_1$ denotes a stress of a JIS No. 5 specimen under 2% pre-strain, and $\sigma_2$ denotes a stress of the same specimen measured after load release and heat treatment at 170° C. for 2 minutes. Resistance to natural aging was evaluated in the following manner instead of the ordinary accelerated test (for AI values). Tensile test is performed on samples of steel sheet immediately after production and also after aging at room temperature for three months. The samples are rated as poor in bake-hardening properties in either or both of the following cases.

The samples tested after aging are higher than the samples tested immediately after production in the average value of yield point (n=2) by more than 30 MPa.

The samples tested after aging are lower than the samples tested immediately after production in the average value of elongation (n=2) by more than 2%.

The results are shown in Table 2 (in which a x mark indicates samples with poor bake-hardening properties).

In this example, continuous annealing was carried out under the condition different from that shown in FIG. 2. The resulting steel sheet was evaluated.

The sample used in this example is a steel sheet, 1.0-1.6 mm thick, obtained from an experimental slab having the composition shown in No. 3 of Table 1, by hot rolling and cold rolling under the same conditions as mentioned above.

Figure 3:
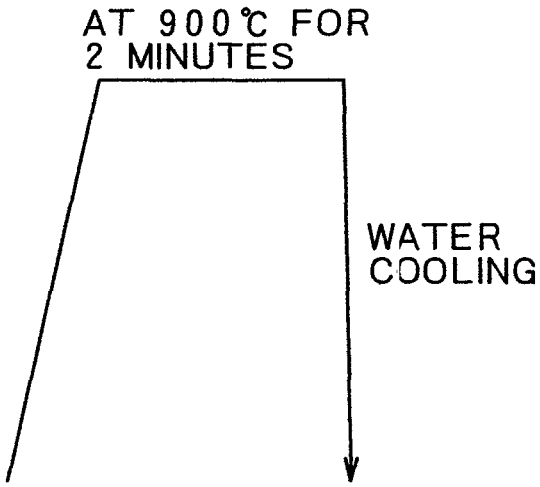
FIG. 3 is a diagram illustrating the heat treatment carried out in another Example.
Figure 4:
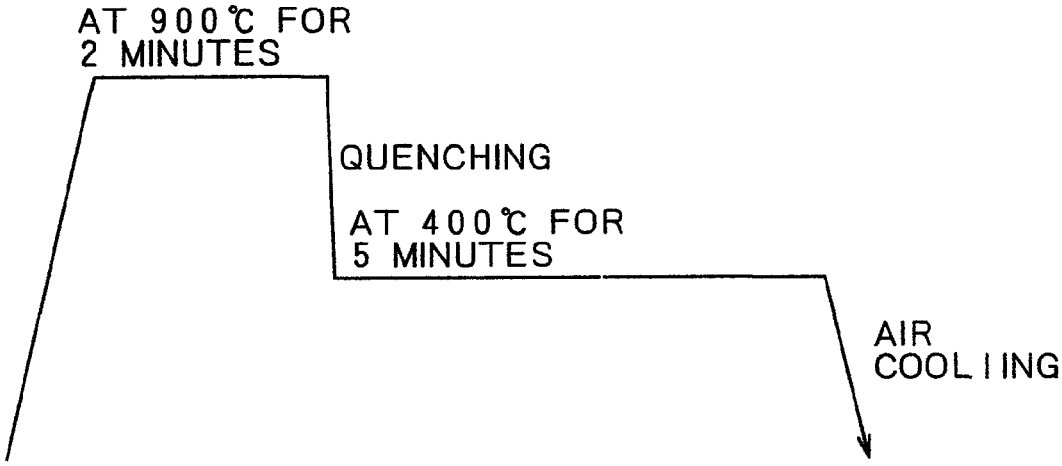
FIG. 4 is a diagram illustrating the heat treatment carried out in another Example.

Sample No. 15 underwent heating at about 900° C. for 2 minutes in a salt bath and then water cooling in the continuous annealing as illustrated in FIG. 3, without keeping at about 400° C. as shown in FIG. 2. Sample No. 16 underwent heating at about 900° C. for 2 minutes in a salt bath, quenching in another salt bath at about 400° C., keeping at about 400° C. for 5 minutes, and air cooling to room temperature, as illustrated in FIG. 4.

Figure 5:
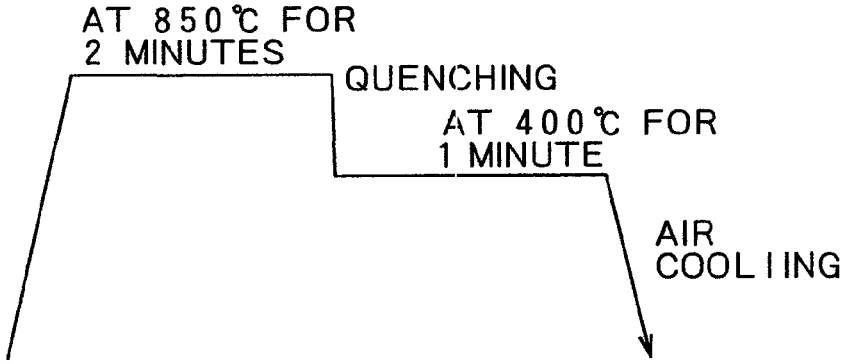
FIG. 5 is a diagram illustrating the heat treatment carried out in another Example.

Sample No. 17 underwent heating at about 850° C. for 2 minutes in a salt bath, quenching in another salt bath at about 400° C., keeping at about 400° C. for 1 minute, and air cooling to room temperature, as illustrated in FIG. 5.

Sample No. 18 underwent heating at about 900° C. for 2 minutes in a salt bath, cooling to about 400° C. at an average rate of 5° C./sec, keeping at about 400° C. for 1 minute, and air cooling to room temperature.

After air cooling to room temperature, samples Nos. 15 to 17 underwent skin pass rolling, with the reduction of area being 0.5-2%. They were finally wound up.

The thus obtained samples Nos. 15 to 17 were tested for tensile strength (TS), total elongation (El), bake-hardening properties (BH), and resistance to natural aging, in the same way as for Samples Nos. 1 to 14. The results are shown in Table 2.

TABLE 1

| Steel designation | Chemical Composition (mass %) | | | | | | | | $A_{c3}$ transformation |
|---|---|---|---|---|---|---|---|---|---|
| No. | C | Si | Mn | P | S | Al | N | Others | point (° C.) |
| 1 | 0.033 | 1.48 | 1.50 | 0.03 | 0.006 | 0.032 | 0.0035 | — | 894 |
| 2 | 0.096 | 1.54 | 1.54 | 0.03 | 0.004 | 0.034 | 0.0041 | — | 870 |
| 3 | 0.157 | 1.57 | 1.53 | 0.02 | 0.004 | 0.033 | 0.0037 | — | 854 |
| 4 | 0.204 | 1.55 | 1.45 | 0.04 | 0.005 | 0.035 | 0.0034 | — | 844 |
| 5 | 0.151 | 0.48 | 1.55 | 0.04 | 0.005 | 1.030 | 0.0042 | — | 806 |
| 6 | 0.147 | 0.30 | 0.32 | 0.04 | 0.004 | 0.030 | 0.0029 | — | 836 |
| 7 | 0.150 | 1.46 | 1.55 | 0.03 | 0.005 | 0.033 | 0.0036 | Mo: 0.2 | 856 |
| 8 | 0.147 | 1.52 | 1.48 | 0.04 | 0.005 | 0.032 | 0.0035 | Ni: 0.2 | 853 |
| 9 | 0.154 | 1.44 | 1.50 | 0.03 | 0.006 | 0.028 | 0.0037 | Cu: 0.2 | 846 |
| 10 | 0.155 | 1.54 | 1.52 | 0.03 | 0.005 | 0.033 | 0.0040 | Cr: 0.2 | 853 |
| 11 | 0.153 | 1.51 | 1.55 | 0.03 | 0.006 | 0.032 | 0.0035 | Ti: 0.03 | 864 |
| 12 | 0.152 | 1.54 | 1.52 | 0.02 | 0.005 | 0.033 | 0.0045 | Nb: 0.03 | 854 |
| 13 | 0.153 | 1.50 | 1.54 | 0.03 | 0.006 | 0.033 | 0.0027 | V: 0.03 | 852 |
| 14 | 0.151 | 1.53 | 1.54 | 0.03 | 0.004 | 0.032 | 0.0039 | Ca: 10 ppm | 853 |

TABLE 2

| | | Structure (areal %) | | | Characteristic Properties | | | |
|---|---|---|---|---|---|---|---|---|
| Experiment No. | Steel designation No. | Retained austenite | Bainite | Ferrite | TS (MPa) | El (%) | BH (MPa) | Resistance to natural aging |
| 1 | 1 | 1 | 30 | 70 | 585 | 22 | 58 | x |
| 2 | 2 | 7 | 68 | 25 | 730 | 20 | 88 | ○ |
| 3 | 3 | 12 | 88 | 0 | 870 | 23 | 105 | ○ |
| 4 | 4 | 15 | 85 | 0 | 995 | 22 | 133 | ○ |
| 5 | 5 | 13 | 87 | 0 | 776 | 20 | 102 | ○ |
| 6 | 6 | 2 | 73 | 25 | 740 | 18 | 68 | x |
| 7 | 7 | 12 | 88 | 0 | 1030 | 20 | 143 | ○ |
| 8 | 8 | 12 | 88 | 0 | 983 | 23 | 121 | ○ |
| 9 | 9 | 13 | 87 | 0 | 885 | 24 | 118 | ○ |
| 10 | 10 | 13 | 87 | 0 | 910 | 20 | 104 | ○ |
| 11 | 11 | 13 | 87 | 0 | 921 | 22 | 120 | ○ |
| 12 | 12 | 12 | 88 | 0 | 933 | 21 | 115 | ○ |
| 13 | 13 | 13 | 87 | 0 | 915 | 22 | 109 | ○ |
| 14 | 14 | 14 | 86 | 0 | 864 | 24 | 110 | ○ |
| 15 | 3 | 1 | 99 | 0 | 1054 | 6 | 120 | x |
| 16 | 3 | 12 | 88 | 0 | 865 | 24 | 48 | ○ |

TABLE 2-continued

| Experiment No. | Steel designation No. | Structure (areal %) Retained austenite | Bainite | Ferrite | Characteristic Properties TS (MPa) | EI (%) | BH (MPa) | Resistance to natural aging |
|---|---|---|---|---|---|---|---|---|
| 17 | 3 | 13 | 27 | 60 | 767 | 26 | 38 | ○ |
| 18 | 3 | 12 | 43 | 45 | 821 | 24 | 98 | ○ |

The foregoing results lead to the following conclusion. Incidentally, No. below denotes experiment No. in Table 2.

Steel sheets in Nos. 2 to 5, 7 to 14, and 18 exhibit good characteristic properties because they meet the requirements specified in the present invention.

In No. 18, the conditions other than the cooling rate to 400° C. are the same as those of No. 3. The difference in the cooling rate causes formation of ferrite in the course of cooling.

Other samples than mentioned above, which fail to meet any of the requirements specified in the present invention, have some flaws as mentioned below.

No. 1 has insufficient retained austenite but has excess ferrite on account of low carbon content. Therefore, it is poor in bake-hardening properties and is liable to strain aging at normal temperature.

No. 6 has insufficient retained austenite on account of low content of (Si+Al) and low content of Mn. Therefore, it is poor in bake-hardening properties and is liable to strain aging at normal temperature.

No. 15 suggests that a prescribed amount of retained austenite can be secured if the sample is quenched in the continuous annealing step and then kept at about 400° C. for a certain period of time.

No. 16 suggests that keeping the steel sheet at about 400° C. for a long time after quenching from about 900° C. is not desirable for a large number dislocations necessary for the bake-hardening properties. A probable reason for this is that dislocations which have resulted from quenching from about 900° C. recover, resulting in a low dislocation density, if the steel sheet is kept at about 400° C. for an excessively long time.

No. 17 suggests that it is desirable to heat the steel sheet at a temperature higher than the $A_3$ point at the beginning of the continuous annealing process, if the steel sheet is to have a large number dislocations necessary for the bake-hardening properties.

Figure 6:
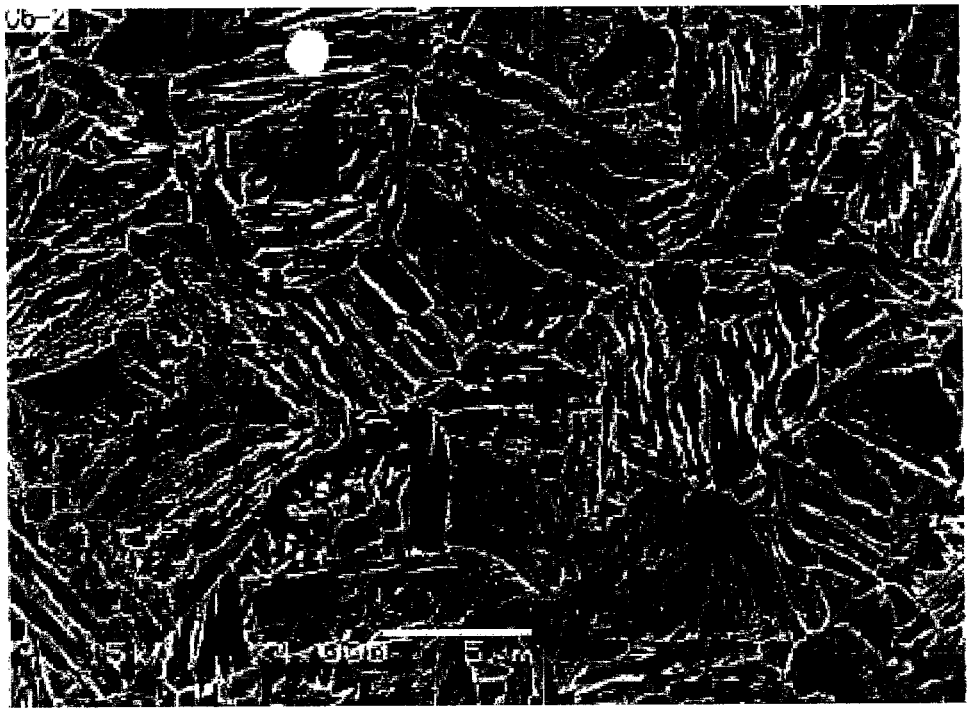
FIG. 6 is an SEM microphotograph showing the structure of the steel sheet in experiment No. 3.
Figure 7:
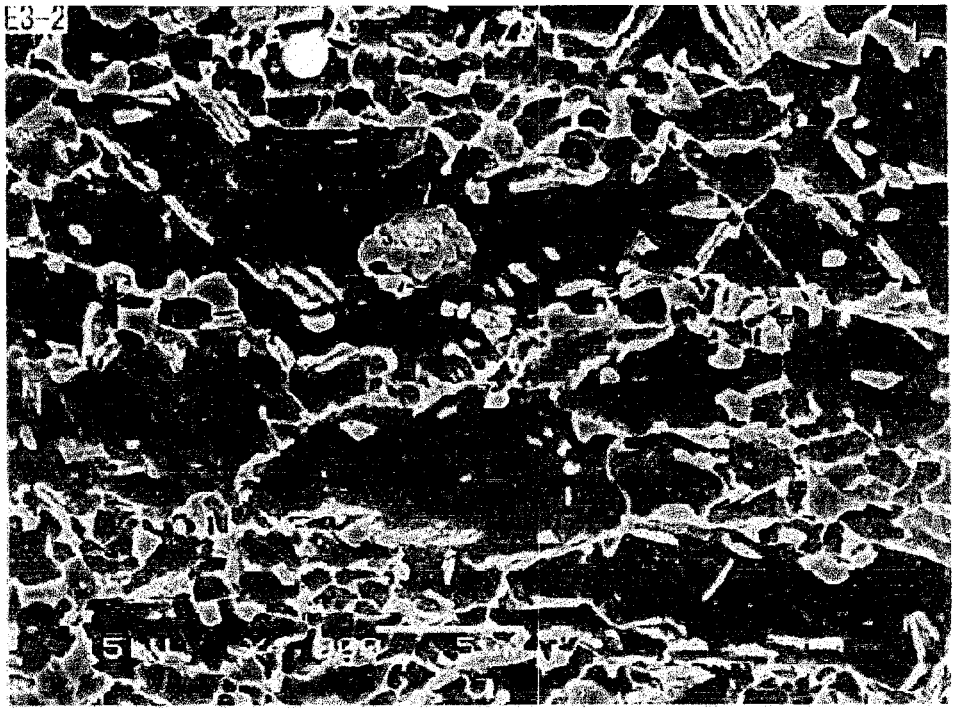
FIG. 7 is an SEM microphotograph showing the structure of the steel sheet in experiment No. 17.

FIG. 6 is an SEM microphotograph (×4000) which shows the structure of No. 3 conforming to the present invention. It is noted that the sample has the bainite structure. By contrast, FIG. 7 is an SEM microphotograph (×4000) which shows the structure of No. 17 in a comparative example. The black parts represent ferrite and the gray parts represent retained austenite. It is seen that ferrite dominates bainite.

What is claimed is:

1. A cold rolled dual phase steel sheet with good bake-hardening properties containing (in terms of percent by mass):

C: no less than 0.06% and less than 0.25%;

Si+Al: 0.5 to 3%;

Mn: 0.5 to 3%;

P: no less than 0.03% and no more than 0.15%; and

S: no more than 0% and no more than 0.02%, wherein the steel sheet consists of (in terms of space factor):

bainite: more than 80%,and ratained austenite: at most 20%, wherein the steel sheet contains no ferrite other than the ferrite in the bainite, no pearlite and no martensite, and wherein a 2% pre-strain places the steel sheet under a first stress;

after heating the steel sheet at 170° C. for 20 minutes the 2% pre-strain places the steel sheet under a second stress; and the difference between the second stress and the first stress is larger than 100 MPa.

2. The dual phase steel sheet as defined in claim 1, further containing at least one of the following constituents (in terms of percent by mass):

Mo: no less than 0.05% and no more than 1%;

Ni: no less than 0.05% and no more than 0.5%;

Cu: no less than 0.05% and no more than 0.5%; and

Cr: no less than 0.05% and no more than 1%.

3. The dual phase steel sheet as defined in claim 1, further containing at least one of the following constituents (in terms of percent by mass):

Ti: no less than 0.01% and no more than 0.1%;

Nb: no less than 0.01% and no more than 0.1%; and

V: no less than 0.01% and no more than 0.1%.

4. The dual phase steel sheet as defined in claim 1, further containing (in terms of percent by mass) at least one of Ca: no less than 3 ppm and no more than 30 ppm and REM: no less than 3 ppm and no more than 30 ppm.

5. The dual phase steel sheet as defined in claim 1, containing

P: no less than 0.05% and no more than 0.15%.

6. A method of making a dual phase steel sheet according to claim 1, the method comprising providing a steel comprising (in terms of percent by mass):

C: no less than 0.06% and less than 0.25%,

Si+Al: 0.5 to 3%,

Mn: 0.5 to 3%,

P: no less than 0.03% and no more than 0.15%, and

S: more than 0% and no more than 0.02%;

maintaining the steel at a temperature higher than $Ar_3$ for 10-200 seconds;

cooling the steel to a bainite transformation temperature in the range of 350-500° C. at an average cooling rate larger than 3° C./s;

maintaining the steel at the bainite transformation temperature for more than one second;

cold rolling the steel; and producing the dual phase steel sheet of claim 1.

* * * * *